US008196221B2

(12) United States Patent
Fuwausa et al.

(10) Patent No.: US 8,196,221 B2
(45) Date of Patent: Jun. 12, 2012

(54) BOTTLE OPENER ATTACHED TO A GARMENT

(75) Inventors: Michelle J. Fuwausa, Columbia, MD (US); Michael F. Houtkin, Coral Springs, FL (US)

(73) Assignee: Michael Houtkin, Coral Springs, FL (US)

( * ) Notice: Subject to any disclaimer, the term of this patent is extended or adjusted under 35 U.S.C. 154(b) by 344 days.

(21) Appl. No.: 12/370,949

(22) Filed: Feb. 13, 2009

(65) Prior Publication Data

US 2009/0199325 A1 Aug. 13, 2009

Related U.S. Application Data

(60) Provisional application No. 61/028,201, filed on Feb. 13, 2008.

(51) Int. Cl.
*A41D 13/00* (2006.01)

(52) U.S. Cl. ..... 2/69; 2/209.13; 81/3.09; 81/3.15; 81/3.25

(58) Field of Classification Search ..... 2/244, 209.13, 2/195.1, 268, 75, 94, 20; 81/3.09, 3.55, 3.56, 81/3.57, 3.07, 3.25, 3.27, 3.47, 3.31, 3.35, 81/3.15, 3.4; 220/592.17, 315, 810, 755; 7/151, 152, 156; D8/33, 34, 38, 18; 40/586; 446/28, 26; 224/182, 194; 24/3.7
See application file for complete search history.

(56) References Cited

U.S. PATENT DOCUMENTS 3,048,067 A * 8/1962 Miles et al. ..... 81/3.08
3,414,117 A * 12/1968 Leeds ..... 206/5
3,500,477 A 12/1968 Meszaros
4,414,865 A * 11/1983 Brooks et al. ..... 81/3.09
4,433,597 A * 2/1984 Rowland ..... 81/3.09
4,805,238 A * 2/1989 Crafts ..... 2/20
4,894,866 A 1/1990 Walker
5,133,233 A 7/1992 Erwin
5,261,299 A 11/1993 Kondos
D363,157 S * 10/1995 Rodgers ..... D2/866
5,467,888 A * 11/1995 Brandstrom et al. ..... 220/319
5,948,003 A * 9/1999 Shefflin ..... 606/234
6,098,497 A * 8/2000 Larose ..... 81/3.4
6,174,075 B1 1/2001 Fuwausa
6,185,772 B1 2/2001 Bates
6,312,449 B1 * 11/2001 Chang et al. ..... 606/234
D471,356 S * 3/2003 Eaton ..... D3/264
6,638,298 B1 * 10/2003 Shefflin ..... 606/234
6,857,755 B1 2/2005 Lewis
7,086,121 B2 * 8/2006 Lippincott ..... 24/3.13
7,284,284 B2 * 10/2007 Wysopal ..... 2/209.13
(Continued)

FOREIGN PATENT DOCUMENTS

AU 2005100026 A4 1/2005
(Continued)

*Primary Examiner* — Gary L Welch
*Assistant Examiner* — Khaled Annis
(74) *Attorney, Agent, or Firm* — Gottlieb, Rackman & Reisman, P.C.

(57) ABSTRACT

A wearable garment with a stitched or otherwise secured accessory, which is preferably a one piece PVC or injection molded plastic accessory. The accessory includes a base for attachment to the garment and a disk in the general shape of a bottle cap and bottle flange. The disk is attached together with the base by a flexible tether. The base unit is glued, stitched or otherwise attached to the wearable garment and the, bottle cap shape, is snapped onto the base unit.

18 Claims, 4 Drawing Sheets

U.S. PATENT DOCUMENTS

| | | | | |
|---|---|---|---|---|
| 7,325,255 | B2 | 2/2008 | Cunliffe | |
| 7,370,558 | B1 | 5/2008 | Chenelia | |
| 7,725,954 | B2 * | 6/2010 | DelPrete et al. | 2/69.5 |
| 2002/0069450 | A1 * | 6/2002 | McNamara | 2/244 |
| 2006/0117462 | A1 * | 6/2006 | Wysopal | 2/209.13 |
| 2006/0150798 | A1 * | 7/2006 | Tafolla | 84/327 |
| 2006/0180585 | A1 * | 8/2006 | Cunningham et al. | 220/203.06 |
| 2007/0163393 | A1 | 7/2007 | Ondeck et al. | |

FOREIGN PATENT DOCUMENTS

| | | |
|---|---|---|
| CA | 2327055 | 5/2002 |

* cited by examiner

BOTTLE OPENER ATTACHED TO A GARMENT

RELATED APPLICATIONS

This application claims priority to provisional application Ser. No. 61/028,201 filed Feb. 13, 2008, entitled "PVC OR Plastic Attached TO A WEARABLE GARMENT" and incorporated herein by reference in its entirety.

BACKGROUND OF THE INVENTION a. Field of Invention

This invention relates generally to wearable garment incorporating a novel accessory preferably made of PVC (polyvinyl chloride) or other plastic material. The accessory is sized and shaped so that it can be used as a bottle opener. A wearable garment with a stitched or appliquéd plastic which could be injection molded plastic, in the general shape of a bottle cap, a separate plastic flange to fit or snap-on the plastic bottle cap shape, preferably in a flexible one-piece unit with a connecting sleeve or bridge. The molded plastic, or PVC, in the shape of a bottle cap, can be attached to any area of the wearable garment. The preferred positioning would be at the front of the lower left hand side of the wearable garment. The, bottle cap shape, can be separated from the base unit, but would still be connected with a sleeve or connecting cantilever bridge to the base unit which is attached to the wearable garment. The application can aesthetic and functional as the bottle cap shape would be preferably larger than an actual size bottle, produced for the consumer marketplace. The larger size would allow the plastic or PVC bottle cap to fit over an actual bottle cap and can be used to twist-off and/or as a bottle opener.

b. Description of the Prior Art

Many types of plastic or rubber articles have been made or proposed for wearable garments; see for example my U.S. Pat. No. 6,174,075 Illuminated Ornamentation/Amusement Device where an image or logo molded from PVC is placed on the surface of a hat and LED's are underneath placed underneath. Canadian Pat. No. 2327055, discloses an "Article for Clothing with Bottle Cap Gripping Patch", that describes a protective patch or medallion affixed to an article of clothing use to facilitate the removal of a twist-off cap, Australian Pat. No. AU2005100026 A4, describes a "Bottle Opening Assembly", having a hollow domed shape that is attached to a t-shirt for opening a bottle. These patents use a plastic or rubber affixed or secured to wearable apparel, including for instance shirts, hats, jackets backpacks or shoes. In the prior art an object made of PVC or plastic was completely attached to a wearable garment, and did not have a flexible connecting cantilever sleeve or joint allowing separation or even detachment from the attached base or garment.

OBJECTIVES AND SUMMARY OF THE INVENTION

It is an objective to improve prior art through which a new assembly can be provided to display logos and other decorative elements and at the same time have the functional ability to remove a twist-off and/or flip-off bottle cap.

It is another objective that the new assembly for presenting original artwork, colors and application of the manufactures as provided on their original bottle cap.

It is another objective of the present invention to provide a garment with an accessory made of a pliable soft plastic or PVC that provides easier access and extension of the of a bottle opener from the garment. The accessory also limits the spillage from a beverage and potential smell of alcohol and/or subsequent potential damage to the wearable garment.

The present invention pertains to a wearable garment with a stitched, sawn, glued or otherwise secured accessory, which is preferably made as a one-piece PVC or injection moulded plastic. The accessory includes a base for attachment to the garment and a disk in the general shape of a bottle cap. The disk is attached together with the base by a flexible tether. The base unit is glued, stitched or otherwise attached to the wearable garment and the, bottle cap shaped disk, is snapped onto the base unit. If possible, the, bottle cap removing and holding disk, and base are larger than the standard glass bottles used in the consumer marketplace where an actual size bottle cap with a logo or design could be attached to the top of the disk to in order to provide for aesthetical and/or for promotional purposes. The, bottle cap removing disk can be separated from the base unit, but still remains connected with a connecting strap or tether to the base which is attached to the wearable garment. The plastic or PVC accessory also functions to remove a twist off or flip off type bottle cap.

BRIEF DESCRIPTION OF THE DRAWINGS

The invention will be better understood by reference to the following description, taken in connection with the appended drawings, in which the reference numerals indicate the parts, and in which.

DETAILED DESCRIPTION OF THE INVENTION

Figure 1:
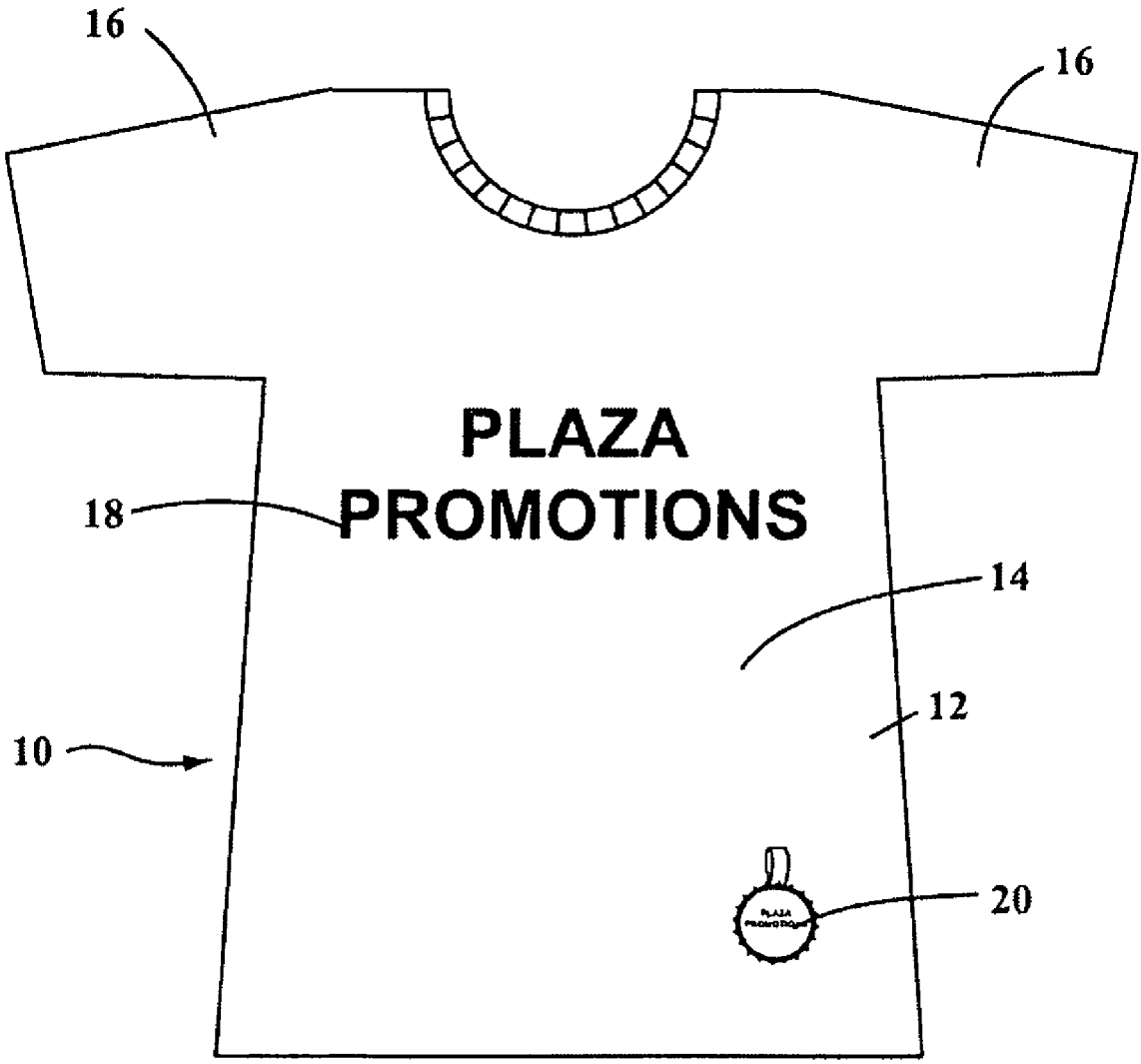
FIG. 1 shows an article of clothing or garment with an accessory constructed in accordance with this invention.

Referring now to the figures, a typical garment 10 such as a t-shirt 10 includes a body 12 with a front or chest area 14 and arms 16. The front area 14 may include or be provided with printed indicia 18.

Importantly, garment 10 is also provided with an accessory 20, the accessory 20 is preferably made of PVC or other plastic material, plastic in the shape of a bottle cap attached to the wearable garment. The accessory could be attached to the garment 10 by any well known means such as by machine stitching, gluing, or other chemical or heat processing.

Figure 2:
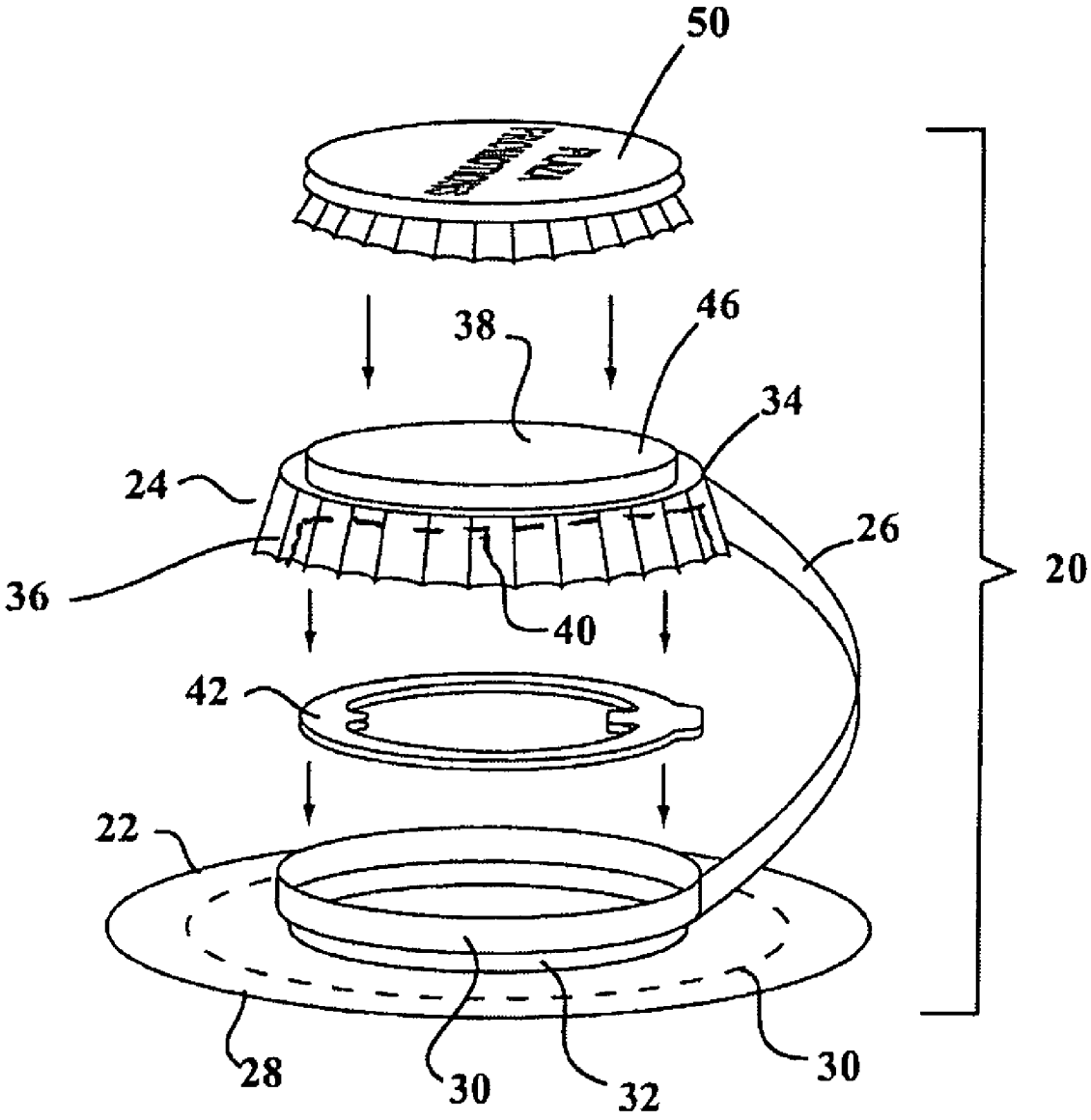
FIG. 2 shows a perspective exploded view of the accessory attached to the garment of FIG. 1.

Referring to FIG. 2, accessory 20 includes a base 22, a disk 24 and a strap or tether 26 attaching the base 22 and the disk 24 to each other. Preferably base 22 is formed with a flat, preferably circular or annular plate 28. Plate 28 is made of a thin material so that it can be sewn to the garment, for example along line 30. Alternatively, if the accessory 20 is attached by other means, the plate can have a different shape. The plate 28 is formed with an annular crown 30 attached to the rest of the plate 22 by a neck 32 having a slightly reduced diameter.

Disk 24 has a cylindrical wall 34 which may be smooth, or may be formed with a plurality of axial grooves 36. The top surface 38 of disk 24 can be featureless or can be provided with some decorative indicia (not shown). At the bottom, the disk 24 is formed with an internal cavity 40. The cavity 40 is sized and shaped so that the disk 24 can be snapped onto and form an interference fit with crown 30. Importantly, both disk 24 is constructed and sized so that it can fit snuggly over the twist off cap of a bottle (not shown). An O-ring 42 may be provided inside the cavity 40 to reinforce it, if necessary.

Figure 3:
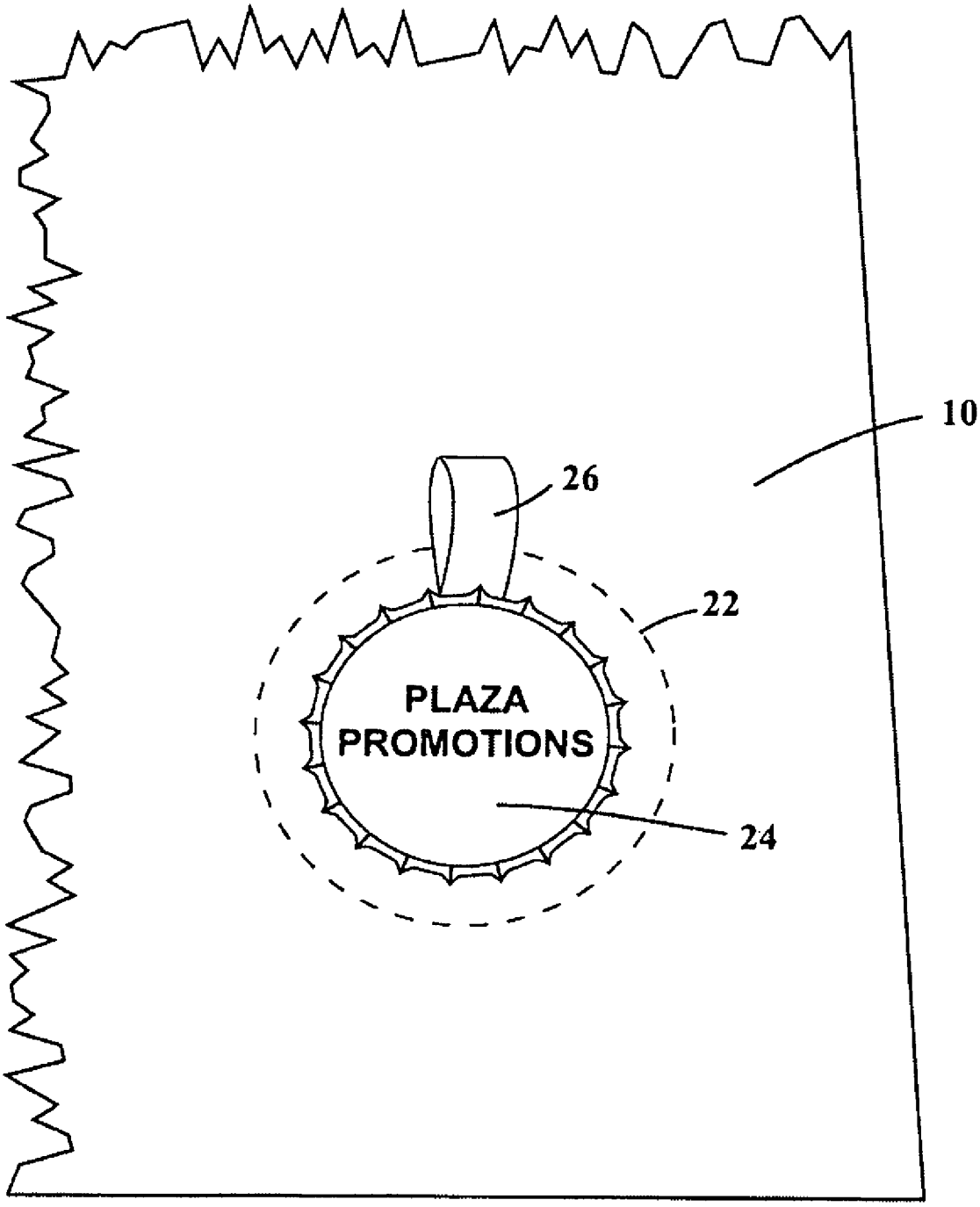
FIG. 3 shows the close-up front view of the garment of FIG. 1 with the attached accessory of FIG. 2.

The strap 46 is made flexible enough to allow the disk 24 to be attached to, and remove from the crown 30. Normally, the garment 10 is worn with the disk 24 being attached to the base 22 as shown in FIG. 3. In this figure, the garment 10 is shown with the plate 28 disposed underneath the garment and protruding through a hole having the same dimension as crown 30. Of course, the plate 28 can also be attached to the top of the garment surface.

The wearer can decide to use the accessory 20 to open the twist-off cap of a bottle. For this purpose, he first removes or detaches the disk 24 from neck 30 and places it on the twist-off cap. He then grabs the disk 24 and uses it to twist the twist-off cap until the cap separates from the bottle.

In one embodiment, the twist off cap is discarded. In another embodiment, the surface 38 is formed with a boss 46. The boss 46 is sized and shaped to receive the twist-off cap 50 that has been removed from a bottle (not shown) and mounted on the boss 46. The cap 50 is then maintained in the disk by the interference fit between the boss 46 and cap 50 or by glue. In this manner, the cap 50 becomes part of the accessory 20. Of course, the user is free at any time to remove and discard cap 50 and use the disk 24 to remove the cap of another bottle.

In an alternate embodiment, the accessory 20 is provided or sold to users or customers with a cap 50.

Figure 4:
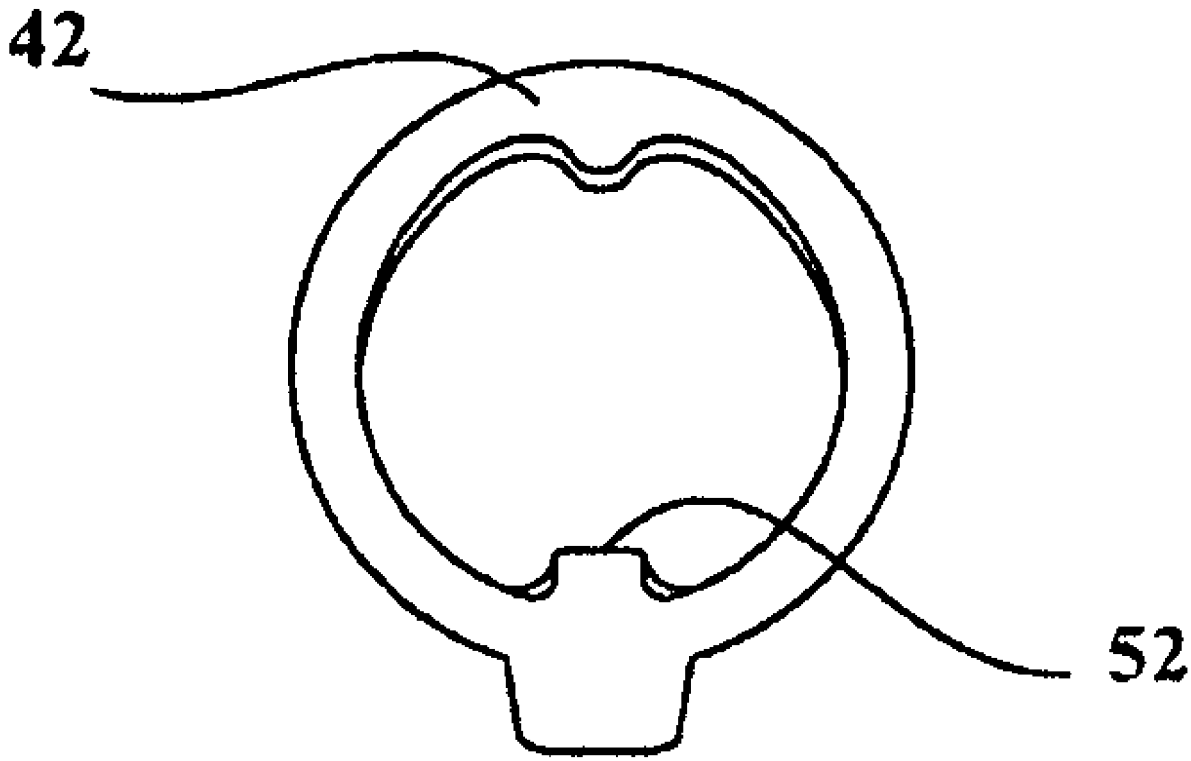
FIG. 4 shows an O-ring inserted into the cap removing disk used for flip-off type bottle.

In another embodiment, the interior cavity 40 is sized and shaped to accept and remove a cap that is flipped off a bottle rather than a twisted off. For this purpose, the O-ring 42 is formed with a radial extension or lip 52 shown in FIG. 4 that can be used to engage and remove the cap from a bottle of soda, beer or alcoholic beverage.

Preferably, the whole accessory 20 is formed as an integral piece from PVC or other plastic material by molding or other well known processes.

The subject garment assembly provides several advantages over the prior art. It provides an accessory that can be readily mounted on any part of the garment, although the lower left hand corner shown in the drawings is preferable. It provides plenty of display area for advertising and other informational material not only on the front the t-shirt but also on the accessory (e.g. surface 40). More importantly, the accessory can also be used to display the bottle cap top surface as the bottle cap rests and is engaged by the accessory. The strap or tether 26 allows a user to remove the cap of any appropriate bottle at will. Since the user can hold both the bottle and the accessory securely in his hand, the bottle can be opened without the fear of spilling its contents. The accessory can be easily designed to open either twist-off or flip-off bottle caps.

Other modifications may be made to this invention without departing from its scope as defined in the appended claims.

We claim:

1. A combined garment assembly comprising:

a wearable garment having a surface with a top;

an accessory attached to the wearable garment, said accessory including a base secured to said to of said surface and having an accessory opening overlapping said surface, said accessory being attached to said surface without creating any openings in said surface corresponding to said accessory opening, a disk sized and shaped to fit into said accessory opening, said disk being selectively removable from said accessory opening and being formed with a cavity sized and shaped to fit over the cap of a bottle to allow a user to remove the cap from the bottle; said disk being removably disposed in said accessory opening when not in use; and a tether permanently attaching said disk to said base and having a length sufficient to allow the use of the disk as a bottle opener when removed from said accessory.

2. The assembly of claim 1 wherein said base further includes a crown for selectively receiving and holding said disk.

3. The assembly of claim 1 wherein said accessory is formed with a boss sized and shaped to receive and hold a cap removably, said cap being sized and shaped to cover said cavity.

4. The assembly of claim 3 wherein said cap is a bottle cap.

5. The assembly of claim 1 wherein said accessory is a molded integral element made of a plastic material.

6. The assembly of claim 1 wherein said disk is sized and shaped to remove a twist-off bottle cap.

7. The assembly of claim 1 wherein said disk is sized and shaped to remove a flip or snap top from the bottle.

8. The assembly of claim 1 wherein said base is formed with a cylindrical boss having an interior wall sized and shaped to receive and form an interference fit with said disk.

9. The assembly of claim 8 wherein said accessory further includes an O-ring disposed in said cavity, said O-ring being sized and shaped to fit over and remove a snap-off cap from a bottle.

10. The assembly of claim 1 wherein said base and said disk are coplanar when said disk is disposed in said accessory opening.

11. The assembly of claim 1 wherein said opening and said disk are circular.

12. An accessory for a wearable garment with a surface, said attachment comprising:

a base sized and shaped to be attached to a top of the wearable garment, said base having a circular opening, said opening being covered on one side by the surface of said garment after said base is attached the wearable garment;

a disk releasably attached into said circular opening, said disk having a central cavity sized and shaped for selectively removing the cap of a bottle after said disk has been detached from said base; and a tether permanently attaching said disk to said base and having a length selected to allow the use of the disk to remove said cap from the bottle after the disk has been removed from the base.

13. The accessory of claim 12 wherein said base includes an annular boss with an inner wall forming said circular opening and releasable accepting said disk.

14. The accessory of claim 12 wherein said inner wall and said disk form an interference fit.

15. The accessory of claim 12 wherein one of said boss and said disk has a top surface shaped to accept and hold an accessory cap, said accessory cap covering said cavity.

16. The accessory of claim 15 wherein said accessory cap is a bottle cap.

17. The accessory of claim 12 further comprising an O-ring disposed in said cavity, said O-ring being sized and shaped to selectively remove a snap-off bottle cap from a bottle.

18. The accessory of claim 12 wherein the cap of the bottle is cylindrical and wherein said cavity is cylindrical and sized to fit co-axially over and engage said bottle cap so that relative twisting between the bottle and said accessory causes the cap to be removed.

* * * * *